US008967918B2

(12) United States Patent
Schneider et al.

(10) Patent No.: US 8,967,918 B2
(45) **Date of Patent: *Mar. 3, 2015**

(54) ANCHOR ARRANGEMENT FOR USE WITH OPEN MAT SYSTEM; OPEN MAT SYSTEM; AND METHODS FOR REINFORCING EARTH

(71) Applicant: Reynolds Presto Products Inc., Richmond, VA (US)

(72) Inventors: Cory Schneider, Green Bay, WI (US); William Handlos, Manitowoc, WI (US); Gary Bach, Appleton, WI (US); Bryan S. Wedin, Green Bay, WI (US)

(73) Assignee: Reynolds Presto Products Inc., Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/164,947

(22) Filed: Jan. 27, 2014

(65) Prior Publication Data

US 2014/0140777 A1 May 22, 2014

Related U.S. Application Data

(63) Continuation of application No. 13/069,954, filed on Mar. 23, 2011, now Pat. No. 8,651,771.

(51) Int. Cl.

| | |
|---|---|
| ***E02B 3/12*** | (2006.01) |
| ***E02D 5/80*** | (2006.01) |
| ***E02D 17/20*** | (2006.01) |

(52) U.S. Cl.

CPC ..... *E02D 5/80* (2013.01); *E02D 17/202* (2013.01)

USPC ..... 405/302.7; 405/302.6; 405/259.1; 405/258.1; 24/545; 24/530

(58) Field of Classification Search

USPC ..... 405/302.7, 302.6, 302.4, 259.1, 258.1, 405/15, 16, 17; 24/545, 530

See application file for complete search history.

(56) References Cited

U.S. PATENT DOCUMENTS

| | | | |
|---|---|---|---|
| 1,653,465 | A | 12/1927 | Montan et al. |
| 3,208,119 | A | 9/1965 | Seckerson |
| 4,044,513 | A | 8/1977 | Deike |
| 4,610,568 | A | 9/1986 | Koerner |
| 4,858,408 | A | 8/1989 | Dunn |
| 4,953,501 | A | 9/1990 | Moreau |
| 5,147,145 | A | 9/1992 | Facey et al. |
| 5,171,108 | A | 12/1992 | Hugron |
| 5,358,356 | A | 10/1994 | Romanek et al. |
| 5,651,641 | A | 7/1997 | Stephens et al. |
| 5,927,906 | A | 7/1999 | Bach et al. |
| 6,951,438 | B2 | 10/2005 | Carpenter |

(Continued)

OTHER PUBLICATIONS

"A Permanent and Green Solution to Stream Bank Stabilization on Iowa's Rock Creek," *Land and Water*, pp. 8-13 (Sep./Oct. 2010).

(Continued)

*Primary Examiner* — Frederick L Lagman
(74) *Attorney, Agent, or Firm* — Merchant & Gould P.C.

(57) ABSTRACT

An open mat system to reinforce turf includes an anchor arrangement to help secure the mat to the turf. The anchor arrangement includes an anchor head embedded in the earth, a cable connected to the anchor head, a cable connector device, and a brace. The cable is inserted into the connector device, which holds the cable against withdrawal from the connector device. The brace includes a receiver, in which the cable connector device is removably oriented in the receiver.

19 Claims, 10 Drawing Sheets

(56) References Cited

U.S. PATENT DOCUMENTS

| | | | | |
|---|---|---|---|---|
| 7,062,886 | B2 | 6/2006 | Auriemma | |
| 7,588,395 | B2 | 9/2009 | Carpenter | |
| 7,695,219 | B2 | 4/2010 | Carpenter | |
| 7,789,594 | B2 | 9/2010 | Stahm | |
| 7,828,499 | B2 | 11/2010 | Carpenter | |
| 7,862,259 | B2 | 1/2011 | Carpenter | |
| 7,950,878 | B2 | 5/2011 | Carpenter | |
| 8,651,771 | B2 * | 2/2014 | Schneider et al. | 405/302.7 |
| 2004/0048522 | A1 | 3/2004 | Facey et al. | |
| 2005/0089377 | A1 | 4/2005 | Allen | |
| 2008/0235921 | A1 | 10/2008 | Zwier | |
| 2009/0016826 | A1 | 1/2009 | Carpenter | |
| 2009/0317190 | A1 | 12/2009 | Carpenter | |

OTHER PUBLICATIONS

Geoterra™ Structural Mat System Specification & Installation Guideline, pp. 1-17 (Jun. 18, 2008).

Installation Guide, ScourStop™ transition mats combine with vegetation to mechanically protect the soil from erosion, pp. 1-28 (Nov. 2007).

Partial International Search Report for PCT/US2012/026305 mailed Jun. 26, 2013.

Prevent Scour and Erosion with the Green Solution, 8 pages (Aug. 26, 2009).

ScourStop™ Instructions Cohesive Soils, 4 pages (2010).

ScourStop™ Instructions Non-Cohesive Soils, 1 page (2010).

* cited by examiner

ANCHOR ARRANGEMENT FOR USE WITH OPEN MAT SYSTEM; OPEN MAT SYSTEM; AND METHODS FOR REINFORCING EARTH

CROSS REFERENCE TO RELATED APPLICATIONS

This application is a continuation of application Ser. No. 13/069,954, filed Mar. 23, 2011, issued as U.S. Pat. No. 8,651,771 which application is incorporated herein by reference in its entirety.

TECHNICAL FIELD

This disclosure concerns an anchor arrangement for use with an open mat system to reinforce earth, such as soil or ground or turf and provide mechanical protection over highly erosive areas. This disclosure also concerns open mat systems utilizing such anchor arrangements and methods for use.

BACKGROUND

Highly erosive areas include storm water pipe outfalls, curb outfalls, over-flow structures, and shorelines. In regions where there is a high shear force resulting from excessive velocities and turbulences, environmental scour can result.

To prevent scour, turf reinforcement mats have been provided. Such mats provide mechanical protection over these highly erosive areas and are typically placed over soil cover. Anchors are needed to secure the mat to the earth, turf, soil, or ground. Improvements in anchor arrangements and mat systems are desirable.

SUMMARY

In one aspect, an anchor arrangement for use with an open mat system to reinforce turf is provided. The anchor arrangement includes an anchor head constructed and arranged to be embedded in earth. A cable is connected to the anchor head. A cable connector device is provided. The cable is inserted into the connector device, and the connector device holds the cable against withdrawal from the connector. A brace having a receiver is provided. The cable connector device is removably oriented within the receiver in the brace.

In one embodiment, the brace comprises a pair of legs joined at a bight section to form a u-shaped receiver. Each of the legs has a mat holding segment extending from an end opposite of the bight section. The cable connector device is removably oriented in the u-shaped receiver.

In one embodiment, the cable connector device, when oriented in the u-shaped receiver, is even with or below each mat holding segment.

In another aspect, an open mat system to reinforce turf is provided. The system includes at least a first open grid mat against the turf. The open grid mat includes a matrix of rigid members defining open pockets in between the rigid members. At least one anchor arrangement to secure the mat to the turf is provided. The anchor arrangement includes an anchor head embedded in the earth, a cable connected to the anchor head, a cable connector device, and a brace. The cable is inserted into the cable connector device, and the connector device holds the cable against withdrawal from the connector device. The brace has a pair of legs joined at a bight section to form a u-shaped receiver. Each of the legs has a mat holding segment extending from an end opposite of the bight section. The u-shaped receiver is oriented within a first one of the open pockets, and each mat holding segment is oriented in a direction against the rigid members. The cable connector device is removably oriented in the u-shaped receiver within the first open pocket.

In one embodiment, there is at least a second open grid mat against the turf. Each of the first and second mats has a pair of side edges and a pair of end edges between the side edges. The at least second open grid mat is adjacent to the first mat so that one of the end edges of the first mat is overlapping one of the end edges of the second mat. There is at least one rivet through the overlapping end edges to secure the first and second mats together.

In one embodiment, there is at least a third open grid mat against the turf. The third open grid mat has a pair of side edges and a pair of end edges between the side edges. The at least third open grid mat is adjacent to the first mat so that one of the side edges of the first mat is overlapping one of the side edges of the third mat. There is at least one spring clip around the overlapping side edges to secure the first and third mats together.

In one embodiment, each of the first mat, second mat, and third mat side edges have tabs separated by recessed areas. The recessed areas of each of the mats are sized and arranged to receive the tabs of another of the mats.

In one embodiment, the spring clip includes at least a first arm and a second arm joined by a bridge section to form a u-shape. The first arm has a first lance projecting therefrom, the first lance having a free end. The free end extends in a direction toward the second arm and the bridge section. The second arm has a second lance projecting therefrom, the second lance having a free end. The free end of the second lance extends in a direction toward the first arm and the bridge section.

In one embodiment, the first, second, and third mats are part of a plurality of open grid mats arranged adjacent to each other and against the turf. Each of the open grid mats is a matrix of rigid members defining open pockets in between the rigid members. Each of the mats has a pair of side edges and a pair of end edges between the side edges. The mats in the plurality are arranged so that one of the end edges of one mat overlaps one of the end edges of another of the mats, and one of the side edges of one mat overlaps one of the side edges of another of the mats. Each of the mats of the plurality has at least four anchor arrangements per mat. There are at least three rivets through overlapping end edges of each of the mats. There are at least two spring clips around the overlapping side edges of the mats.

In another aspect, a method of reinforcing turf is provided. The method includes laying a first open grid mat against the turf, the open grid mat being a matrix of rigid members defining open pockets in between the rigid members. The mat has a top and an opposite bottom. The bottom is against the turf. The method also includes the step of securing the mat to the turf by embedding an anchor head in the earth by inserting the anchor head into the earth through a first one of the open pockets. The anchor head has a cable connected thereto extending from the anchor head in the earth and through the first open pocket. The cable has a portion secured to a cable connector device holding the cable against withdrawal from the connector. The cable connector device is inserted into a receiver in a brace. The brace and cable connector device are inserted into the first open pocket. There is also the step of pulling the cable through the cable connector device to engage the anchor head.

In on example, the brace has integrated into the interior portion a set of projections that restricts the connector device from disengaging in an upward direction when the cable is tensioned for final tightening of the anchor system.

In one embodiment, the method includes after the step of pulling the cable through the cable connector device, cutting the cable a distance above the cable connector device to form a cut end; looping the cut end back in a direction toward the cable connector device; and then inserting the cut end into the cable connector device.

In one embodiment, the step of inserting the brace and cable connector device includes recessing the cable connector device within the first open pocket relative to the top of the mat.

In one embodiment, the step of inserting the cable connector device into a receiver in a brace includes inserting the cable connector device into a brace comprising a pair of legs joined at a bight section to form a u-shaped receiver. Each of the legs has a mat holding segment extending from an end opposite of the bight section.

In one embodiment, the step of inserting the brace and cable connector device into the first open pocket includes inserting the u-shaped receiver within the first open pocket so that each mat holding segment is oriented in a direction against the top of the mat.

In one embodiment, the method further includes laying a second open grid mat against the turf and adjacent to an end edge of the first open grid mat, and securing the first mat and second mat together by inserting at least one rivet through adjacent end edges of the mats.

In one embodiment, the method further includes laying a second open grid mat against the turf and adjacent to a side edge of the first open grid mat, and securing the first mat and second mat together by interlocking the adjacent side edges and snapping at least one clip around the adjacent side edges of the mats.

In another aspect, a clip connecting together adjacent open grid mats is provided. The clip includes a first arm and a second arm joined by a bridge section to form a u-shape. The first arm has a first lance projecting therefrom with a free end. The free end extends in a direction toward the second arm and the bridge section. The second arm has a second lance projecting therefrom with a free end. The free end of the second lance extends in a direction toward the first arm and the bridge section.

In one embodiment, the first lance projects at an angle of 30-45° relative to the first arm, and the second lance projects at an angle of 30-45° relative to the second arm.

In one embodiment, the first lance is oriented a distance of greater than 50% of an overall length of the first arm from the bridge section, and the second lance is oriented a distance of greater than 50% of an overall length of the second arm from the bridge section.

It is to be understood that both the foregoing general description and the following detailed description are exemplary and explanatory only and are not restrictive of the invention, as claimed. The accompanying drawings, which are incorporated in and constitute a part of this specification, illustrate example embodiments of the invention and together with the description, serve to explain the principles of the invention.

DETAILED DESCRIPTION

A. Overview

Figure 1:
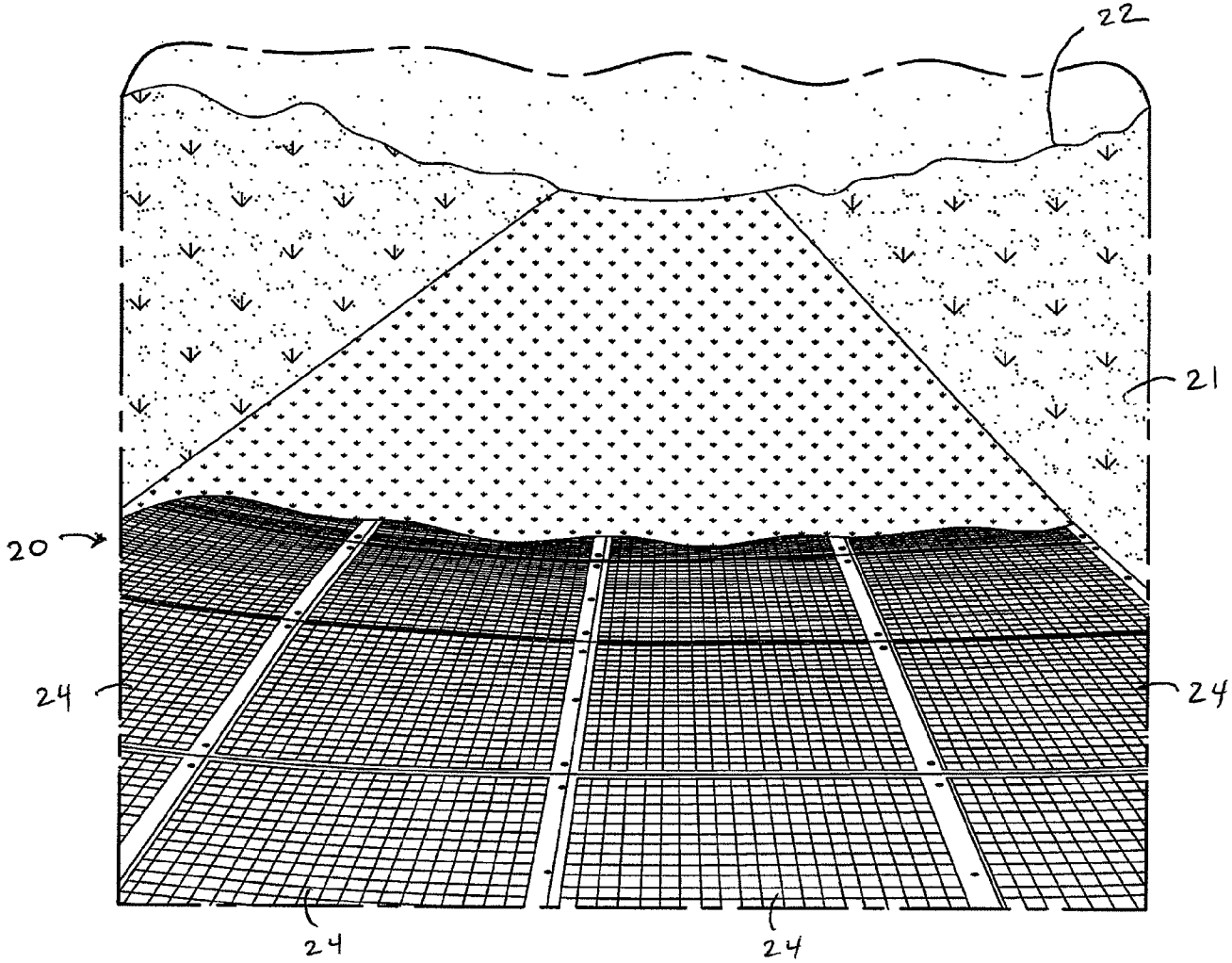
FIG. 1 is a schematic, perspective view of one embodiment of an open mat system, constructed in accordance with principles of this disclosure.

In reference now to FIG. 1, an open mat system to reinforce turf is shown generally at 20. The system 20 is shown reinforcing the turf 21 along a shoreline 22. To prevent scour, the system 20 includes turf reinforcement mats 24 placed over soil cover. In the system of FIG. 1, the system 20 includes a plurality of mats 24. The plurality of mats 24 are arranged adjacent to each other and against the turf. Preferred ways of connecting individual mats 24 are described below.

Figure 2:
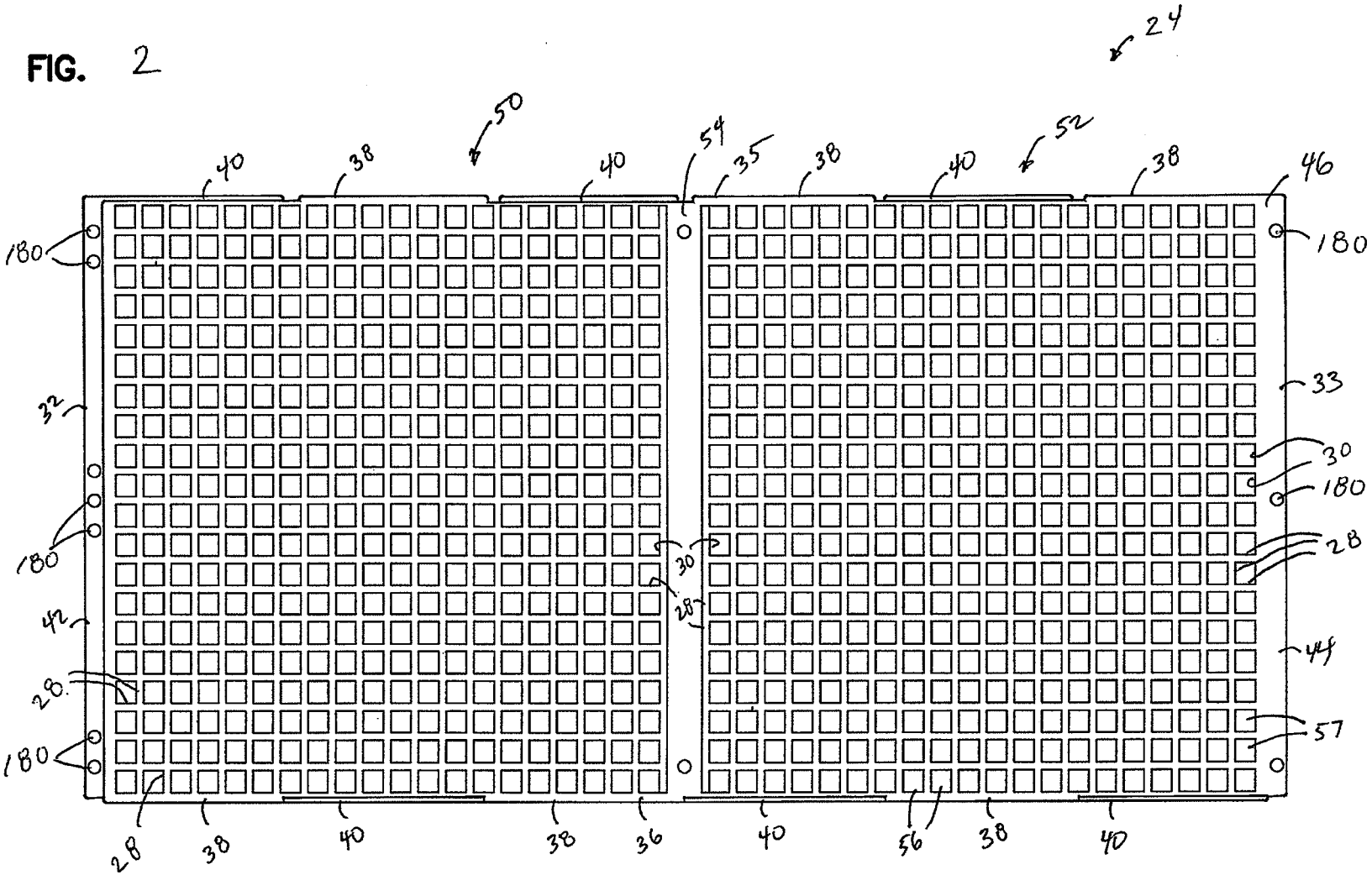
FIG. 2 is a top view of one of the mats used in the open mat system of FIG. 1.

FIG. 2 is a top view of one embodiment of mat 24. The mat 24 may be constructed in accordance with U.S. Pat. No. 4,953,501 incorporated herein by reference. Preferably, the mat 24 comprises an open grid mat of a matrix of rigid members 28 defining open pockets 30 between the rigid members 28. In the example shown, the pockets are square-shaped.

In the preferred embodiment, the open grid mat 24 is made from a hard rigid plastic, such as polypropylene or polyethylene. The use of polymeric material will result in a sturdy mat 24 with high strength and relatively low weight.

A variety of sizes can be used. In preferred embodiments, each mat 24 has a length of at least 3 feet, preferably 4 feet (48 inches) and width of at least 1 foot, preferably 2 feet (24 inches). As can be seen in FIG. 2, the mat 24 has a general rectangular shape.

Mat 24 includes opposite, parallel end edges 32, 33. Extending between the end, edges 32, 33 are opposite, parallel side edges 35, 36. The side edges 35, 36 define the length, while the end edges 32, 33 define the width. The members 28 form a grid between the end edges 32, 33 and side edges 35, 36.

In preferred embodiments, each of the side edges 35, 36 have a plurality of tabs 38 separated by recessed areas 40. In use, when adjacent mats 24 are arranged next to each other, with side edges 35, 36 adjacent and aligned, the recessed areas 40 of one mat 24 is sized and arranged to receive the tabs 38 of the mat 24 that is adjacent to it. In this manner, there is at least a portion of one of the side edges 35, 36 overlapping a portion of the side edges 35, 36 of the adjacent mat without protruding. An example of this can be seen in FIG. 13, described below. Through the tabs 38 and recessed areas 40, the mats 24 intersect with each other along the side edges 35, 36 and form a smooth joint therebetween.

The opposite end edges 32, 33 of the mat 24 are constructed and arranged to overlap with each other, when arranged adjacent to another mat 24. For example, as can be seen in FIG. 2, the end edge 32 has a recessed shelf 42, while the end edge 33 has an overlap extension 44. When one mat 24 is aligned with the end edge of another mat 24, they are aligned so that the shelf 42 in received under the overlap extension 44, to help create an even, smooth, and non-protruding joint or connection point. This can be seen in FIG. 15, explained further below.

Figure 15:
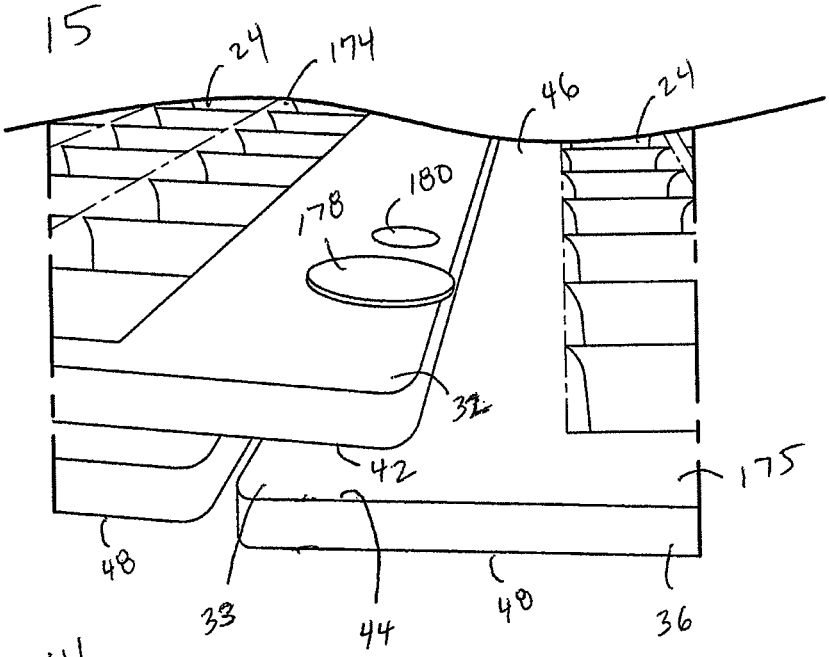
FIG. 15 is a schematic, perspective view showing the rivet and adjacent mats of FIG. 14 after insertion of the rivet.

Each of the mats 24 also has a thickness or height from a top upper surface 46 to an opposite bottom turf engaging surface 48 (FIG. 15). In typical embodiments, this height or thickness is about 0.5 inches.

As can be seen in FIG. 2, in the preferred embodiment, each mat 24 includes a first grid section 50 and a second grid section 52 separated by a strip 54 of solid, non grid area. Typically, the strip 54 has a length that is equal to about one column 56 of pockets 30. The matrix 26 can be described as a plurality of columns 56 of pockets 30, intersecting with rows 57 of pockets 30.

B. Example Anchor System

As mentioned in the background section, open mat systems to prevent or reduce the incidence of scour need to be effectively anchored. Prior anchor systems have used high profile projections that extend above the mat. This high profile can lead to hazards and problems such as persons tripping and falling. Further, the high profile, in combination with high flow hydraulic conditions, can create turbulence in what would otherwise be a laminar flow condition. Turbulence can lead to hydraulic instability and result in increased forces lifting the mat and the soil beneath.

Figure 3:
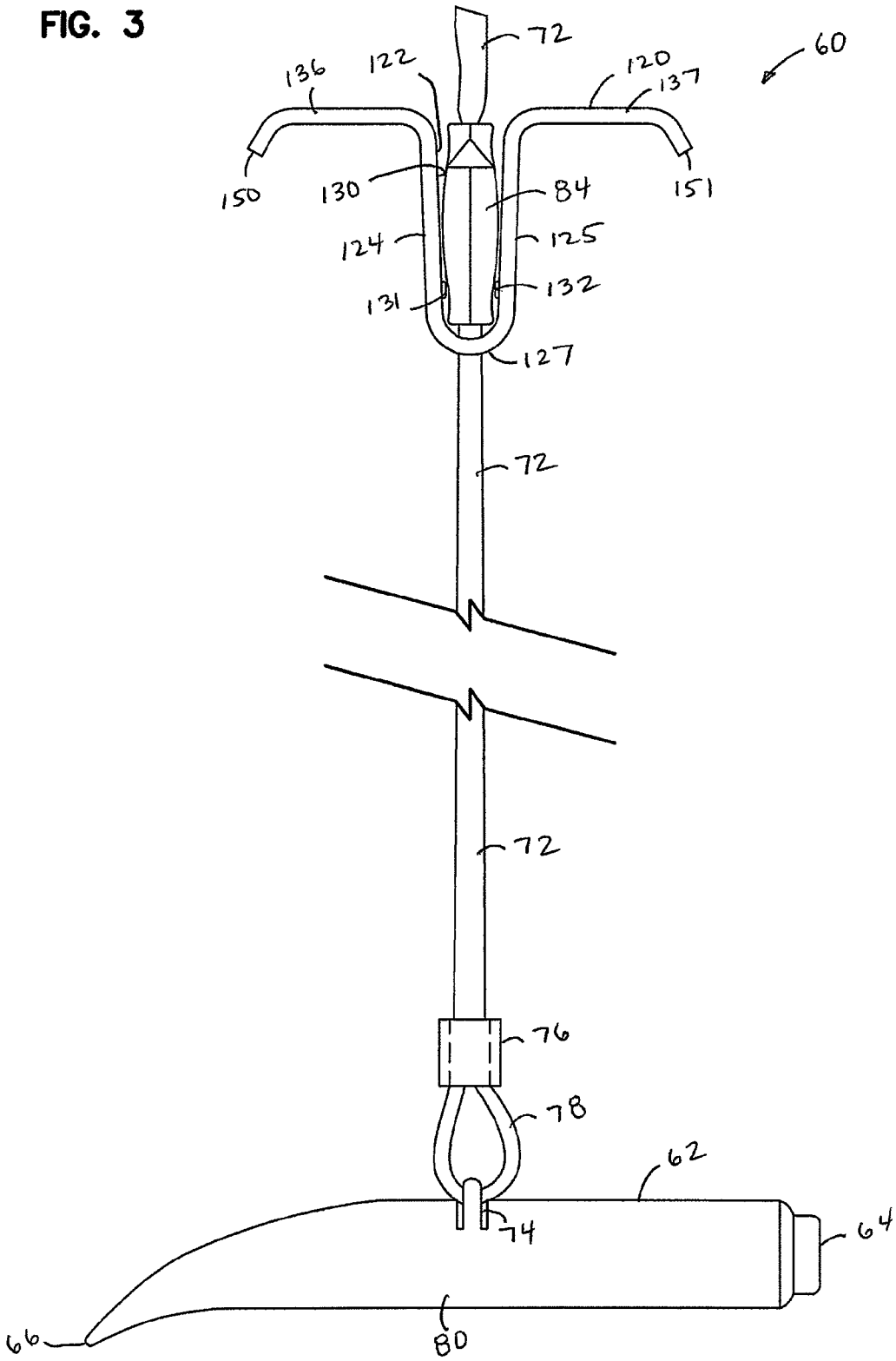
FIG. 3 is a front view of an anchor arrangement for use with the open mat system of FIG. 1, constructed in accordance with principles of this disclosure.

In FIG. 3, one useful anchor arrangement that solves these problems is shown generally at 60. The anchor arrangement 60 is high strength, reliable, and is adjustable to having a low profile relative to the mat 24 to minimize hydraulic flow turbulence and to reduce hazards such as tripping, falling, and cutting. The anchor arrangement 60 is adjustable and can be tightened or re-cinched, if needed.

1. Example Anchor Head

In the embodiment illustrated in FIG. 3, the anchor arrangement 60 includes an anchor head 62 (or foot). The anchor head 62 is constructed and arranged to be embedded in earth 23. In the embodiment shown, the anchor head 62 includes a nose 64 and an opposite tail 66. In the embodiment shown, the tail 66 is tapered. The tail 66 defines an opening 68 (FIG. 4) that is sized to receive a removable drive rod 70. In this manner, the drive rod 70 can be inserted into the opening 68 in the tail 66 and used to push the anchor head 62 into the earth 23 until reaching a suitable depth below the surface of the turf 21. The drive rod 70 is then removed from the anchor head 62 and out of the earth 23.

At that stage, the anchor head 62 is set in the earth 23 to help lock it in place by moving the anchor head 62 from its initial position to a set position. The initial position includes the nose 64 of the anchor head 62 being at the lowest most relative point of the anchor head 62, with the opposite tail 66 being at the highest relative point of the anchor head 62. The set position includes a horizontal position, in which the anchor head 62 is rotated so that the nose 64 is relatively even with the tail 66, such as the orientation shown in FIG. 3. FIG. 5 shows the anchor head 62 as it is being rotated from the initial position of FIG. 4 to the set position of FIG. 3.

One useful anchor head 62 is described in U.S. Pat. No. 4,044,513, incorporated herein by reference. Other embodiments may be used. The anchor head 62 can be made from metal or a polymeric material.

2. Example Cable

The anchor arrangement 60 further includes a cable 72 connected to the anchor head 62. The cable 72 should have a sufficient tensile strength to help secure the mats 24 in the turf 21 against high shear load due to water or other fluid. One suitable cable 72 includes flexible steel cable, such as 3/32 inch galvanized steel cable, nylon coated. The cable may also be made from a polymeric material.

Figure 7:
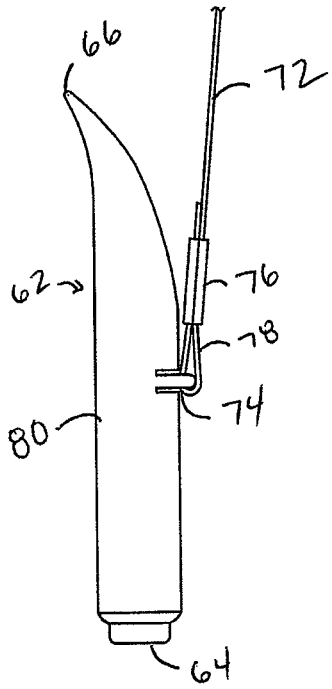
FIG. 7 is a side view of an anchor head and cable used as part of the anchor arrangement of FIG. 3, constructed in accordance with principles of this disclosure.

The cable 72 is connected to the anchor head 62. For example, as can be seen in FIGS. 3 and 7, the anchor head 62 has a through hole 74 with the cable 72 extending therethrough to connect the cable 72 to the anchor head 62. In one implementation, a crimp 76 is used to connect the cable 72 to itself so that the cable 72 forms a loop 78 through the through hole 74 in the anchor head 62.

Figure 4:
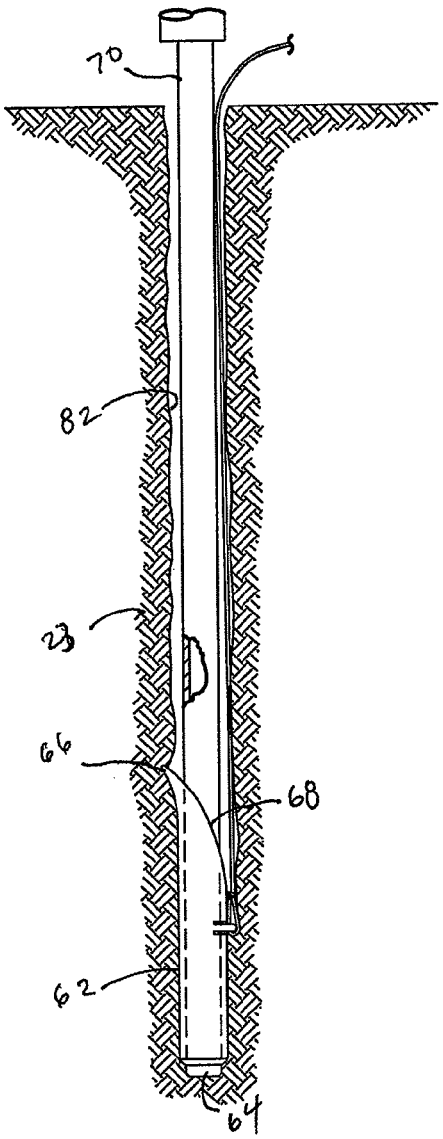
FIG. 4 is a schematic side view showing one step of inserting the anchor arrangement of FIG. 3 into earth, in accordance with principles of this disclosure.
Figure 5:
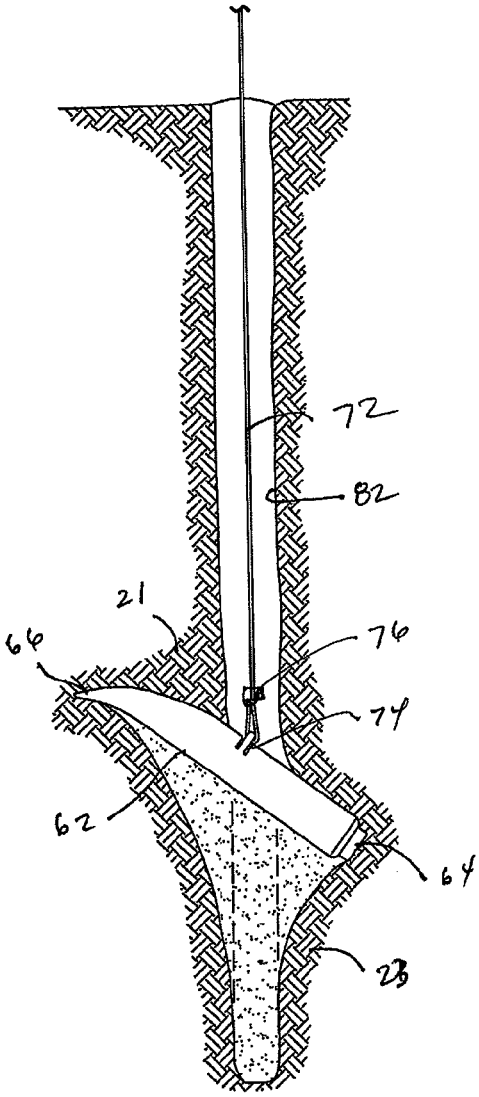
FIG. 5 is a schematic, side view illustrating another step of installing the anchor arrangement of FIGS. 3 and 4 into earth, in accordance with principles of this disclosure.

After the anchor head 62 is inserted in the earth 23, as shown in FIG. 4, the rod 70 is removed, and the cable 72 is used to exert a pulling force on the anchor head 62. This pulling force acts on the area of the anchor head 62 in which the cable 72 is connected to it. As can be seen in FIGS. 3, 5, and 7, the cable 72 is connected at the through hole 74, which is about midway between the tail 66 and nose 64. The pulling force exerted by the cable 72 at this mid-section 80 of the anchor head 62 will cause the anchor head 62 to rotate from a vertical position (FIGS. 4 and 7) about 90° to a horizontal position (FIG. 3). This is because the pulling force on the cable 72 encounters resistance by the earth 23 that is pushing against the tapered tail 66 of the anchor head 62. This resistance by the earth 23 on the tail 66 prevents the anchor head 62 from being pulled straight out of the channel 82 (FIGS. 4 and 5) that was created by the insertion of the anchor head 62 and the drive rod 70. Rather, the earth 23 causes resistance against the tail 66, which causes the anchor head 62 to rotate to the anchored or set position, as shown in FIG. 3.

3. Example Cable Connector Device

In reference again to FIG. 3, the anchor arrangement 60 depicted includes a cable connector device 84. The cable 72 is inserted into the cable connector device 84 in a first direction, and a connector device 84 holds the cable 72 against withdrawal from the connector device 84 in a direction opposite from the first direction.

Figure 8:
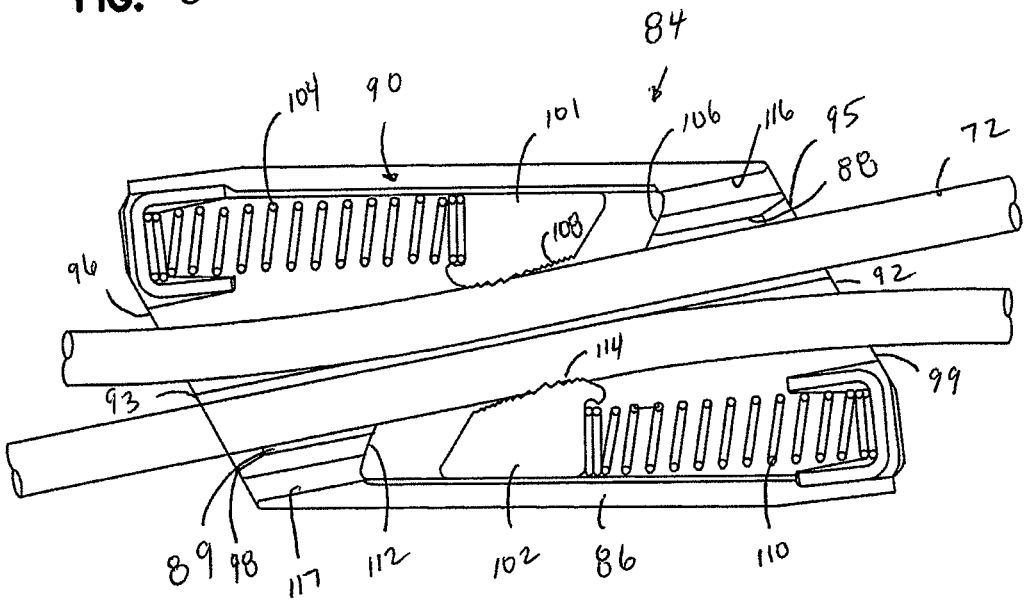
FIG. 8 is a cross sectional view of one embodiment of a cable connector device used with the anchor arrangement of FIG. 3.

An example of one embodiment of connector device 84 is illustrated in cross-section in FIG. 8. In the embodiment shown, the connector device 84 includes a body 86, preferably a metal body, having a pair or twin bores 88, 89 sized to receive the cable 72. As can be seen in FIG. 8, the cable connector device 84 includes a spring loaded wedge arrangement 90 within the body 86, which squeezes the cable 72 within the body 86 to hold the cable 72 against withdrawal from the body 86 of the connector device 84 in a direction opposite from the first direction.

The body 86 of the connector device 84 has first and second opposite ends 92, 93. Each of the bores 88, 89 extend completely between the first end 92 and second end 93. In the embodiment shown, the bore 88 has an insertion hole 95 into the body 86 through the first end 92 and an exit hole 96 through the second end 93. The bore 89 has an insertion hole 98 through the second end 93 and an exit hole 99 through the first end 92.

In this manner, cable 72 could be inserted through the insertion hole 95 of the bore 88, until emerging from the exit hole 96. The wedge arrangement 90 would prevent the cable 72 from being withdrawn from the connector device 84 back through the insertion hole 95. Similarly, the cable 72 could be inserted through the insertion hole 98 of the bore 89 and through the body 86 until emerging through the exit hole 99. The wedge arrangement 90 would prevent the cable 72 from being retracted from the body 88 through the insertion hole 98.

In the embodiment shown in FIG. 8, the wedge arrangement 90 includes first and second wedges 101, 102. The first wedge 101 is oriented within the body 86 so that it protrudes in the bore 88. A first spring 104 urges the first wedge 101 against an internal stop surface 106 within the body 86, when no cable 72 is present in the bore 88. When the cable 72 is inserted through the insertion hole 95 at the first end 92, the cable 72 engages the first wedge 101 and pushes it against the first spring 104. Serrations or teeth 108 on the first wedge 101 dig into the cable 72 and help to prevent the cable 72 from being removed from the body 86 through the insertion hole 95 of the bore 88.

The second wedge 102 operates analogously as the first wedge 101 with respect to the bore 89. As such, the second wedge 102 protrudes into the bore 89 and includes a second spring 110 urging the second wedge 102 against stop surface 112 when no cable is within the bore 89. The second wedge 102 includes serrations or teeth 114 that dig into and by way of friction hold the cable 72 that is inserted through the insertion hole 98 at the second end 93 of the body 86. In this manner, cable 72 inserted through the insertion hole 98 will push against the second wedge 102 and will emerge from the exit hole 99. The teeth 114 and the wedge shape of the second wedge 102 prevent the cable 72 from being withdrawn through the insertion hole 98.

The body 86 also includes access bores 116, 117 from each respective first end 92 and second end 93. The access bores 116, 117 are generally parallel to the bores 88, 89 and allow insertion of a rod-like tool for pushing the respective wedge 101, 102 out of contact with the cable 72, in case the cable 72 needs to be removed from the connector device 84.

One useful connector device 84 is described in patent publication US 2004/0048522, incorporated herein by reference. A commercially available connector device can be obtained under the trade name Gripple®, made by Gripple, Inc., Aurora, Ill.

In use, one of the bores 88, 89 will hold the cable 72 as it extends from above the turf, through the connector device 84, and ending at the anchor head 62.

4. Example Brace

Figure 6:
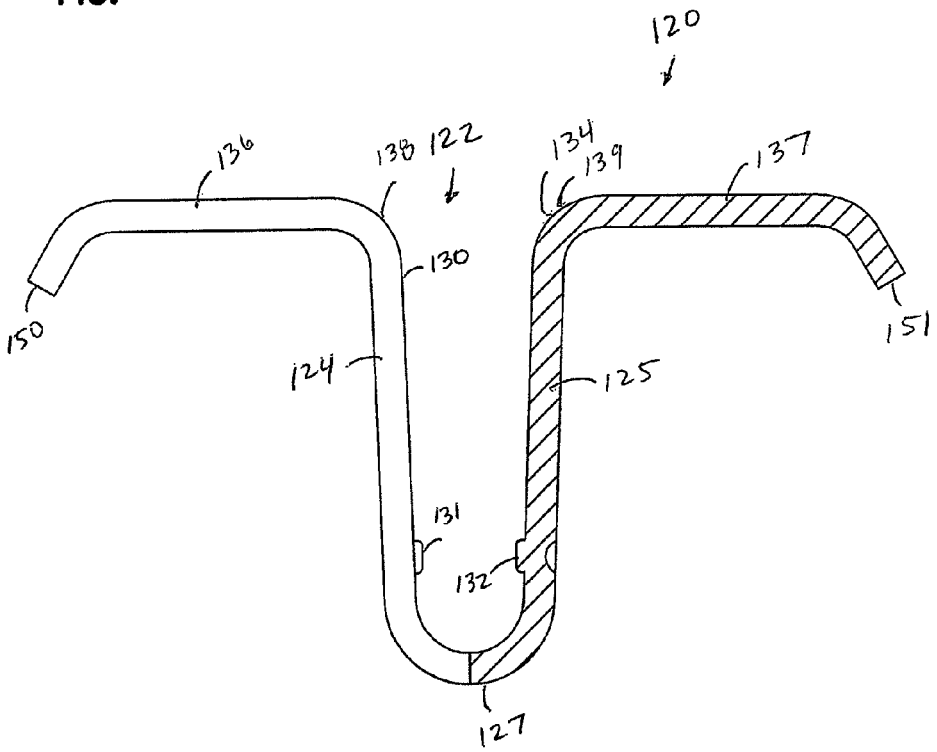
FIG. 6 is a side view of one embodiment of a brace used in the anchor arrangement of FIG. 3, constructed in accordance with principles of this disclosure.

In reference to FIGS. 3 and 6, the anchor arrangement 60 further includes a brace 120. The brace 120 defines a receiver 122, which is used to removably hold the connector device 84.

The brace 120 has the primary function of holding the connector device 84 relative to the mats 24 so that the anchor arrangement 60 stays in place, holding the mat 24 in place. In preferred embodiments, the brace 120 holds the connector device 84 within one of the pockets 30, so that the connector device 84 is recessed relative to the top upper surface 46 of the mat 24.

While a variety of implementations are contemplated, in the particular embodiment illustrated, the brace 120 includes a pair of legs—first leg 124 and second leg 125. The first and second legs 124, 125 are joined at a joining section, such as a bight section 127. In the preferred arrangement shown, the first leg 124, second leg 125, and adjoining bight section 127 is a single, one piece construction that forms receiver 122. Preferably, the receiver 122 is a u-shaped receiver 130.

In the example embodiment of FIG. 6, each of the first leg 124 and second leg 125 includes a nipple or projection 131, 132 extending from the respective leg 124, 125 inwardly into the receiver 122. The projections 131, 132, in the embodiment shown, are located closer to the bight section 127 than to an open mouth 134 of the receiver 122. The projections 131, 132 help to hold the connector device 84 within the receiver 122 by engagement against the body 86 of the connector device 84. The projections 131, 132 also assure that the connector device 84 can be inserted and removed into and from the brace 120 only when the brace 120 is not inset into the mats 24.

Still in reference to FIG. 6, this embodiment of the brace 120 includes first and second mat holding segments 136, 137. In the example shown, the first leg 124 has first mat holding segment 136 extending from the mouth 134 of the receiver 122. It also extends from an end 138 opposite of the bight section 127. Similarly, the second leg 125 has second mat holding segment 137 extending from the mouth 134, which also corresponds to an end 139 opposite of the bight section 127.

Figure 11:
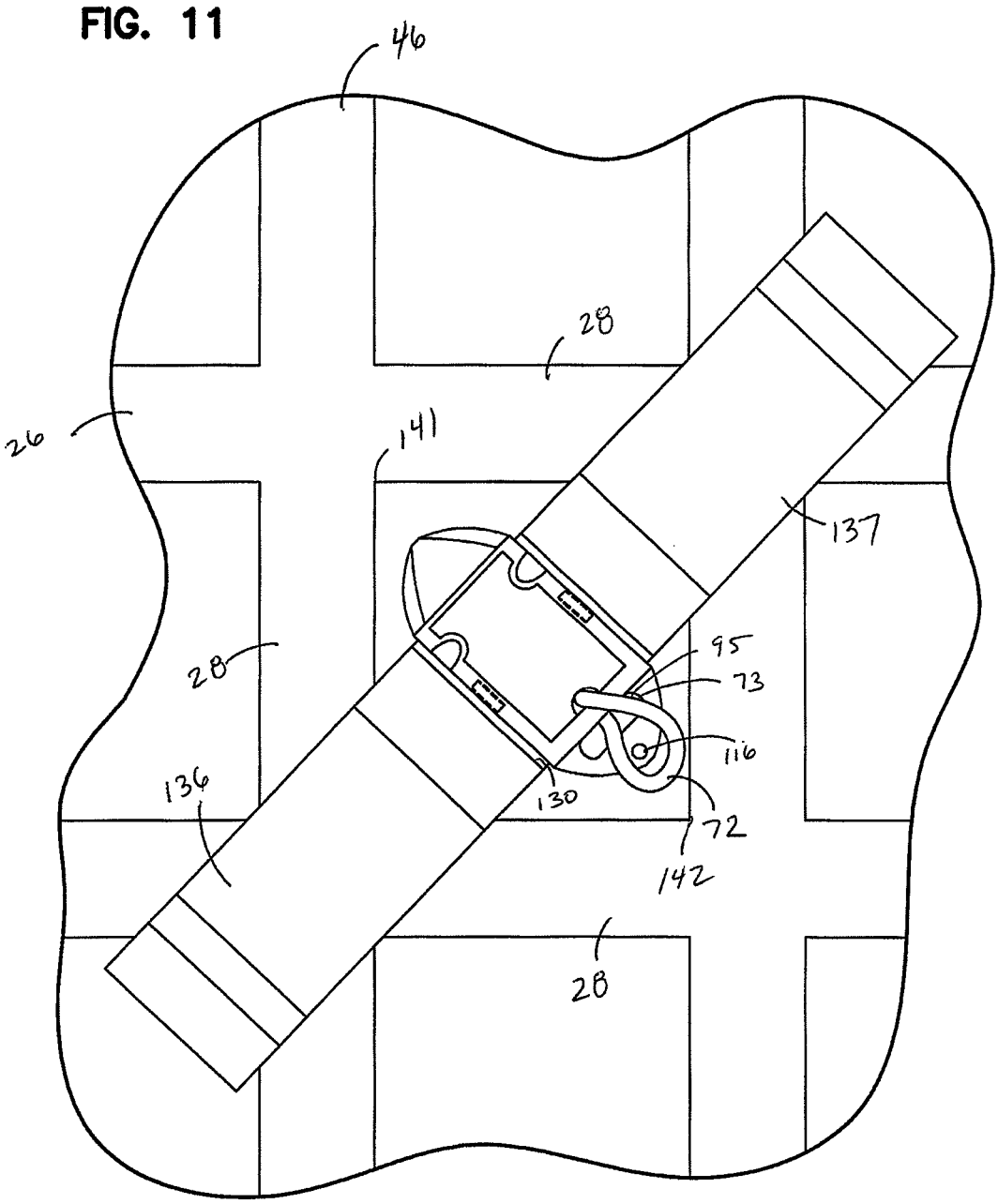
FIG. 11 is a top view of the anchor arrangement of FIG. 3 operably installed in the open mat of FIG. 2, constructed in accordance with principles of this disclosure.

In preferred embodiments, the first mat holding segment 136 is angled between 85° and 95° of the first leg 124, while the second mat holding segment 137 is angled between 85° and 95° of the second leg 125. Typically, the first and second mat holding segments 136, 137 will be at about a 90° angle relative to their respective legs 124, 125. The first and second mat holding segments 136, 137 function to engage in a direction toward, and preferably against, the members 28 of the mat 24. See, for example, FIG. 11. In FIG. 11, the brace 120 holding the connector device 84 can be seen oriented within one of the pockets 30. The mat holding segments 136, 137 are pressed against members 28 of the grid or matrix 26. In the preferred orientation, the brace 120 is sized so that when the brace 120 is holding the connector device 84, it is oriented within the pocket 30 so that the brace 120 extends diagonally through the pocket 30. As such, the first mat holding segment is against an intersection of two of the members 28, while the second mat holding segment 137 is also against an intersection of two of the members 28 located diagonally from the location of where the first mat holding segment 136 is oriented.

When oriented in the manner shown in FIG. 11, the u-shaped receiver 130 generally extends diagonally between opposite corners 141, 142, as where the first and second mat holding segments 136, 137 are located. The connector device 84, which is located within the u-shaped receiver 130, projects or extends beyond the sides 144, 145 of the brace 120 and extends diagonally between the other corners 147, 148 of the pocket 30.

In the example embodiment shown in FIG. 6, each of the mat holding segments 136, 137 has a free end 150, 151 angled relative to the respective mat holding segment 136, 137. As shown in FIG. 6, the free ends 150, 151 are angled from the respective mat holding segments 136, 137 downwardly in a direction toward the remaining portion of the brace 120 in a direction toward the bight section 127.

Figure 9:
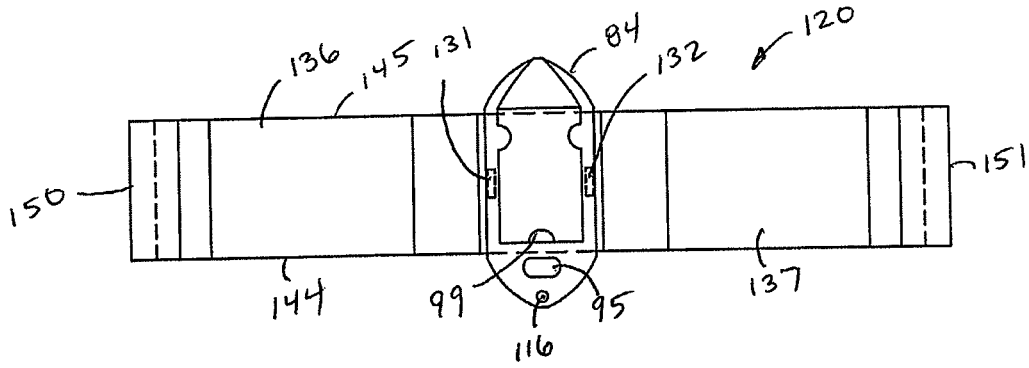
FIG. 9 is a top view of the cable connector device of FIG. 8 removably oriented in a receiver of the brace of FIG. 6, constructed in accordance with principles of this disclosure.
Figure 10:
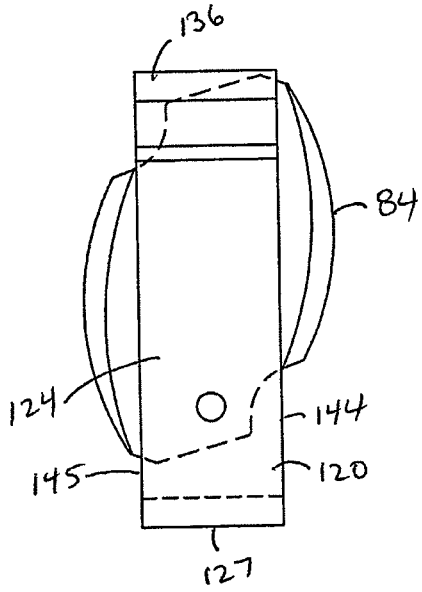
FIG. 10 is a side view of the cable connector device being held by the brace of FIG. 9, constructed in accordance with principles of this disclosure.

A variety of materials can be used for the brace 120. In one useful embodiment, the brace is made from steel, such as 12-gauge, hot rolled steel. The steel may have corrosion inhibitors such as a zinc clear chromate plate finish, although such a finish is optional. The overall width between the projections 131, 132 would be about 0.25-0.35 inch. The width of each leg 124, 125 would be about 0.4-0.6 inch. Typical width across a widest section of the body 86 of the connector device 84 would be about 0.85-0.95 inch, such that the connector device 84 extends beyond the sides 144, 145 (FIGS. 9 and 10) of the brace 120 by about 0.15-0.25 inch on each side 144, 145. The radius of the bight section 127 would be about 0.18 inch. The overall height of the brace 120 from the tip of the bight section 127 to the top of the first and second holding segments 136, 137 would be about 1.5-1.6 inches. The overall width across the widest part of the brace 120 between free end 150 and free end 151 would be about 2.8-3.0 inches. Alternatively, the brace 120 can be molded out of a polymeric material, which will be resistant to corrosion, have a longer life, and has a lower cost.

5. Example Method of Use

In use, the mat 24 is secured to the earth 23 by embedding the anchor head 62 in the earth 23 by inserting the anchor head 62 into the earth 23 through a first one of the open pockets 30. This can be done, for example, by using drive rod 70 into the opening 68 in the anchor head 62 and pressing the anchor head 62 into the earth 23 by use of the rod 70. This is done until the anchor head 62 is at the desired level of depth within the earth 23.

The anchor head will have cable 72 connected thereto, and it will extend from the anchor head 62 and through the first open pocket 30. The connector device 84 will be holding the cable 72 against withdrawal from the connector device 84. The cable connector device 84 is then inserted into the receiver 122 in the brace 120. The brace 120 and the cable connector device 84 are then inserted or placed into the first open pocket 30. Preferably, they will be placed so that the first and second mat holding segments 136, 137 are oriented against intersecting members 28 so that the brace 120 is oriented diagonally across the pocket 30. The connector device 84 will be even with or below the first and second mat holding segments 136, 137 and recessed relative to the top 46 of the mat 24.

The cable 72 is then pulled through the cable connector device 84 to engage the anchor head 62, which will move the anchor head 62 from the insertion position to a set position. Specifically, in the embodiment shown, this will rotate the anchor head 62 from a relatively vertical position in which the tail 66 is above the nose 64, to a relatively horizontal position, in which the tail 66 and nose 64 are relatively even.

After the step of pulling the cable 72 through the cable connector device 84, the cable 72 is preferably cut some distance above the cable connector device 84 to form a cut end 73 (FIG. 11). The cut end 73 is then looped back in a direction toward the cable connector device 84 and then the cut end is inserted into the available bore 88, 89 of the connector device 84. See FIG. 11.

C. Example Mat Connectors

1. Example Clip

Figure 12:
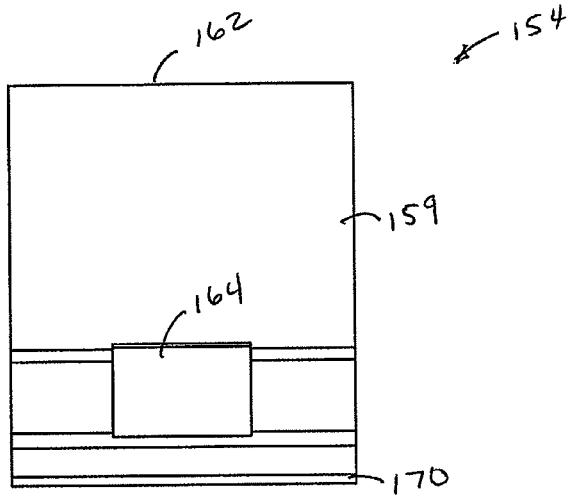
FIG. 12 is a side view of a spring clip used to secure adjacent mats together, constructed in accordance with principles of this disclosure.
Figure 13:
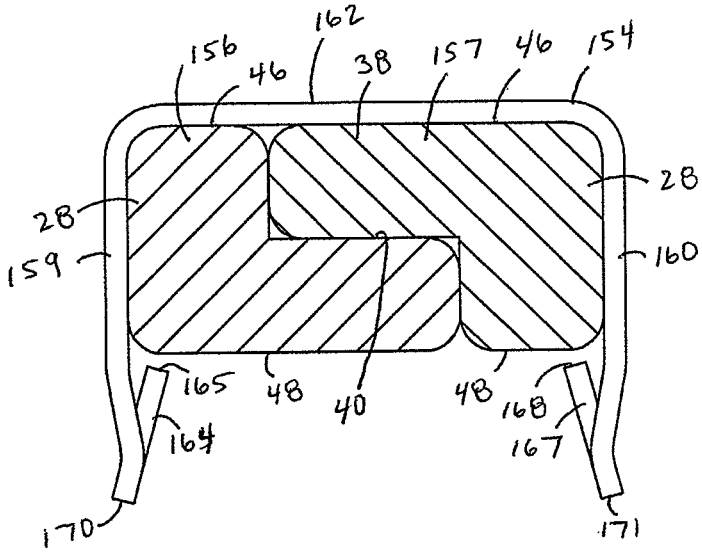
FIG. 13 is a schematic, side view showing the spring clip of FIG. 12 connecting together overlapping side edges of adjacent mats, constructed in accordance with principles of this disclosure.

In reference now to FIGS. 12 and 13, a clip 154 is shown for connecting together adjacent open grid mats 24. FIG. 13 shows a side view of clip 154 and a cross section of side edges 35, 36 of adjacent mats 24. For purposes of illustration, the two mats 24 depicted in FIG. 13 are referred to as first mat 156 and second mat 157. FIG. 12 shows a side view of the clip 154.

In the example embodiment shown in FIGS. 12 and 13, the clip 154 has a first arm 159 and second arm 160 joined by a bridge section 162. Together, the first arm 159, second arm 160, and bridge section 162 form a generally rectangular u-shape. In the embodiment shown, the first arm 159 and second arm 160 is angled relative to the bridge section 162 at about 90°, but can vary between 47° and 53°.

The first arm 159 has a first lance 164 projecting from the first arm 159, and having a free end 165. The free end 165 extends in a direction toward the second arm 160 and the bridge section 162. In example embodiments, the first lance 164 is angled between 10° and 80°, for example about 20-50° relative to the first arm 159.

Similarly, the second arm 160 has a second lance 167 projection from the second arm 160. The second lance 167 has a free end 168, that extends in a direction toward the first arm 159 and the bridge section 162. The second lance 167 extends generally at the same angle relative to the second arm 160 as the first lance 164 extends relative to the first arm 159. In general, each of the first lance 164 and second lance 167 is oriented a distance of greater than 50% of an overall length of each of the first and second arms 159, 160 from the bridge section 162. That is, the first lance 164 is located adjacent to the free end 170 of the first arm 159, and the second lance 167 is located adjacent to the free end 171 of the second arm 160.

The first and second arms 159, 160 fit around the overlapping side edges 35, 36 of the first and second mats 156, 157. In preferred embodiments, the clip 154 is sized so that there is a form of an interference fit, and the clip 154 is a spring clip 154, that snaps around to tightly hold and squeeze the first and second mats 156, 157.

In FIG. 13, it can be seen how the recessed area 40 of the first mat 156 receives the tab 38 of the second mat 157. The first arm 159 and second arm 160 extend from the top upper surface 46 of the mats 156, 157 along the sides of the members 28 through the open pockets 30 so that the lances 164, 167 extend or project below the turf-engaging surface 48 of the mats 156, 157.

In use, the mats 24 are arranged adjacent to each other, so that the side edges 35, 36 of adjacent mats 156, 157 are immediately next to each other, with the recessed areas 40 receiving the tabs 38. This helps to create and even, smooth intersection or engagement point. The spring clip 154 is snapped around overlapping side edges 35, 36 to secure the mats 156, 157 together. The lances 164, 167 extend below the mats 156, 157 such that they dig into the turf 21 and further help secure the mats 156, 157 to the turf 21. In preferred embodiments, when two adjacent mats 24 are connected along their side edges 35, 36, there are at least two spring clips 154, spaced apart from each other, around the overlapping side edges 35, 36 of the adjacent mats 156, 157.

A variety of embodiments are contemplated. One useful embodiment includes making the clip 154 from 22 gauge spring steel, heat treated to 60-70 HR30N. The clip 154 will have a width between the arms 159, 160 of about 1-1.1 inches. Each arm 159, 160 will have an overall length from the bridge section 162 to its free end 170, 171 of about 0.8-0.9 inch. The free ends 165, 168 of each of the lances 164, 167 extend a distance of about 0.3-0.4 inch. The width of each of the arms 159, 160 can be about 0.7-0.8 inch. Each of the lances 164, 167 is approximately centered between the width of each of the arms 159, 160 and will have a length of about 0.2-0.3 inch.

2. Example Rivet

Figure 14:
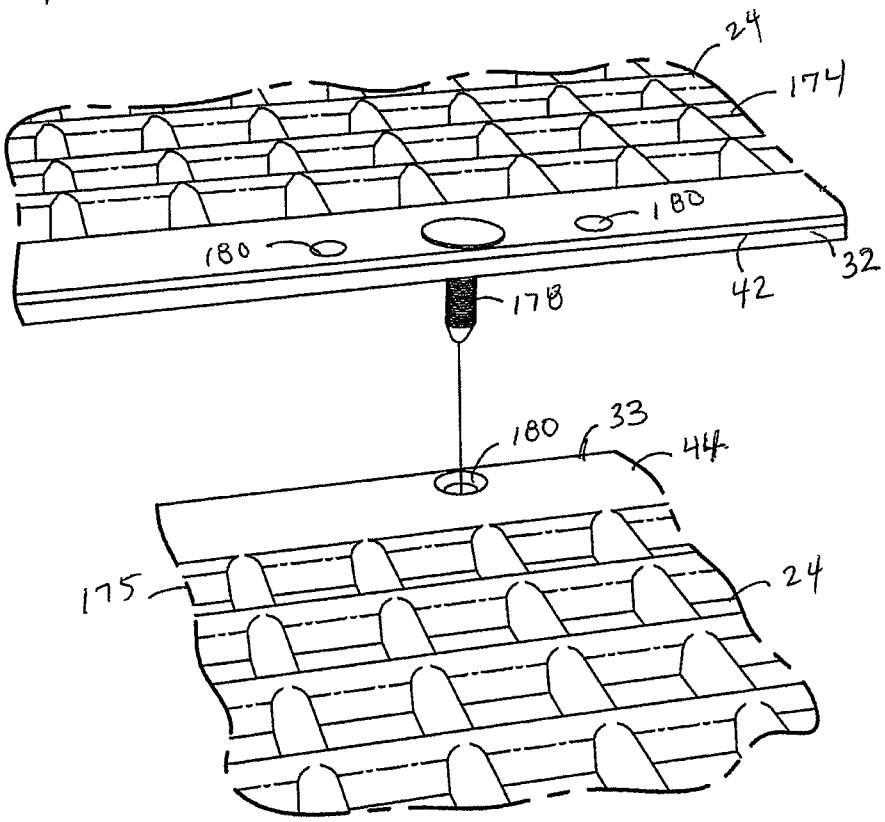
FIG. 14 is a schematic, perspective view of a rivet being used to secure overlapping end edges of two adjacent mats.

Attention is directed to FIGS. 14 and 15, in which an example embodiment of a connection system for the end edges 32, 33 of adjacent mats 24 are illustrated. In FIGS. 14 and 15, the mats 24 will represent adjacent first and second mats, referred to as first mat 174 and second mat 175. It should be understood, however, that the first mat 174 and second mat 175 are mats both constructed in accordance with the description of mat 24, and as shown in FIG. 2. The end edge 32 is shown as being on the first mat 174, while the end edge 33 is shown on the second mat 175. As described above, the end edge 32 has shelf 42 that receives the overlap extension 44 of the end edge 33.

When adjoining adjacent mats 24, such as first and second mats 174, 175 along the end edges 32, 33, the mats 174, 175 are arranged so that there is a smooth meeting or joint or intersection point along the end edges 32, 33. This is done by placing the overlap extension 44 into the shelf 42. At least one rivet 178 is used through apertures 180 in the end edges 32, 33 to secure the first and second mats 174, 175 together. Apertures 180 can be seen in FIG. 2 and FIG. 14. These apertures 180 are aligned, when the end edges 32, 33 are arranged adjacent to each other. The rivet 178 is then inserted, to connect the first and second mats 174, 175 together and form a smooth joint. In FIG. 2, it can be seen how there are more apertures 180 in end edge 32 than in end edge 33. This helps to allow the mats 174, 175 to be aligned along their end edges 32, 33 without requiring a perfect matchup, so long as an aperture 180 in end edge 32 is coaxially aligned with an aperture end edge 33.

FIG. 14 shows the mats 174, 175 before being connected together along end edges 32, 33, along a midpoint of the mats 174, 175. Rivet 178 is shown extending through aperture 180 in mat 174, and being aligned with aperture 180 in mat 175. FIG. 15 shows the mats 174, 175 after being connected together at end edges 32, 33, from a view along the side edge 36 of the mats 174, 175.

In example embodiments, there are at least three rivets 178 through the overlapping end edges 32, 33 of each of the mats 24. The rivets 178 can be made from a hard plastic or from metal.

Other embodiments will be apparent to those skilled in the art from consideration of the specification and practice as disclosed herein. It is intended that the specification and examples be considered as exemplary only.

We claim:

1. An anchor arrangement for use with an open mat system; the anchor arrangement comprising:

(a) an anchor head constructed and arranged to be embedded into earth and be attachable to a cable;

(b) a cable connector device constructed and arranged to hold the cable against withdrawal from the connector device, when a cable is in the cable connector device; and (c) a brace comprising a pair of legs joined at a bight section to form a receiver;

(i) the cable connector device being removably oriented in the receiver.

2. The anchor arrangement of claim 1 wherein:

(a) the receiver of the brace comprises a U-shaped receiver; each of the legs having a mat holding segment extending from an end opposite of the bight section;

(i) the cable connector device being removably oriented in U-shaped receiver.

3. The anchor arrangement of claim 2 wherein each mat holding segment of the brace is angled between 85° and 95° of a respective one of the legs.

4. The anchor arrangement of claim 2 wherein each mat holding segment has a free end angled relative to the respective mat holding segment.

5. The anchor arrangement of claim 2 wherein the cable connector device, when oriented in the U-shaped receiver, is even with or below each mat holding segment.

6. The anchor arrangement of claim 1 wherein the anchor head includes a nose and an opposite tail; the tail having an opening sized to receive a removable drive rod.

7. The anchor arrangement of claim 1 wherein the anchor head has a through-hole for receiving a cable therethrough to connect the cable to the anchor head.

8. The anchor arrangement of claim 1 further comprising a cable connected to the anchor head.

9. The anchor arrangement of claim 8 further comprising a crimp constructed and arranged to connect the cable to itself so that the cable forms a loop through a through-hole in the anchor head.

10. The anchor arrangement of claim 1 wherein the cable connector device is constructed and arranged so that when a cable is inserted into the connector device in a first direction, and the connector device holds the cable against withdrawal from the connector device in a direction opposite from the first direction; the cable connector device including:

(a) a body having twin bores sized to receive the cable; and (b) a spring-loaded wedge arrangement within the body to squeeze the cable within the body and hold the cable against withdrawal from the connector device in a direction opposite from the first direction.

11. A system comprising:

(a) an anchor head for embedding into earth and for being connected to a cable;

(b) a cable connector device for holding a cable against withdrawal from the connector device, when a cable is in the cable connector device; and (c) a brace comprising a pair of legs joined at a bight section to form a receiver;

(i) the cable connector device for being removably oriented in the receiver.

12. The system according to claim 11 wherein the receiver of the brace comprises a U-shaped receiver; each of the legs having a mat holding segment extending from an end opposite of the bight section.

13. The system of claim 12 wherein each mat holding segment of the brace is angled between 85° and 95° of a respective one of the legs.

14. The system of claim 12 wherein each mat holding segment has a free end angled relative to the respective mat holding segment.

15. The system of claim 11 wherein the anchor head includes a nose and an opposite tail; the tail having an opening sized to receive a removable drive rod.

16. The system of claim 11 wherein the anchor head has a through-hole for receiving a cable therethrough to connect the cable to the anchor head.

17. The system of claim 11 further comprising a cable for connection to the anchor head.

18. The system of claim 11 wherein the cable connector device includes:

(a) a body having twin bores sized to receive a cable; and (b) a spring-loaded wedge arrangement within the body to squeeze a cable within the body and hold the cable against withdrawal from the connector device in a direction opposite from the first direction, when a cable is inserted therein.

19. The system of claim 11 further including at least a first open grid mat for orienting against earth; the open grid mat being a matrix of rigid members defining open pockets in between the rigid members; the anchor head being insertable through one of the open pockets to secure the open grid mat to the earth.

* * * * *